United States Patent [19]

Austin

[11] Patent Number: 4,477,084

[45] Date of Patent: Oct. 16, 1984

[54] VANE STRUCTURE FOR ARROWS

[76] Inventor: Charles W. Austin, 4330 NE. 38th St., Des Moines, Iowa 50317

[21] Appl. No.: 473,083

[22] Filed: Mar. 7, 1983

[51] Int. Cl.[3] ..... F41B 5/02

[52] U.S. Cl. ..... 273/423; 244/3.24

[58] Field of Search ..... 273/423; 244/130, 91, 244/34 A, 3.24–3.3

[56] References Cited

U.S. PATENT DOCUMENTS

| | | | |
|---|---|---|---|
| 1,324,014 | 12/1919 | Upson | 244/130 |
| 2,830,818 | 4/1958 | Otto | 273/423 |
| 2,887,319 | 5/1959 | Lay | 273/423 |
| 2,976,043 | 3/1961 | Meyer | 273/423 |
| 3,437,340 | 4/1969 | Grisé273 | 423 X/ |
| 3,667,758 | 6/1972 | Bengtsson | 273/423 |
| 3,765,620 | 10/1973 | Donner et al. | 244/3.24 |
| 4,088,323 | 5/1978 | Munger | 273/423 |

FOREIGN PATENT DOCUMENTS

| | | | |
|---|---|---|---|
| 628041 | 8/1949 | United Kingdom | 273/423 |

*Primary Examiner*—Paul E. Shapiro

*Attorney, Agent, or Firm*—Zarley, McKee, Thomte, Voorhees & Sease

[57] ABSTRACT

An arrow vane which is of a solid one-piece construction and of a soft flexible material such as polyurethane. The vane has a base portion and an integrally formed fin with corrugations therein. The corrugations are at a 45° angle with respect to the base portion. The fin also has openings with V-shaped edges therethrough which permit air to pass through the fin for improved accuracy.

1 Claim, 5 Drawing Figures

VANE STRUCTURE FOR ARROWS

BACKGROUND OF THE INVENTION

The flight of an arrow depends upon the structure of the arrow vanes. Conventional vanes are made from feathers or of some artificial material which is solid in construction. These conventional vanes, however, limit the rotational speed of the arrow and are subject to direct wind contact.

Therefore, it is a primary objective of the present invention to provide an arrow vane which permits faster rotation of the arrow so as to increase accuracy, speed and distance of the arrow in flight.

It is a further objective of the present invention to provide an arrow vane which eliminates cross wind effect while the arrow is in flight.

It is a further objective of the present invention to provide an arrow vane which minimizes air contact.

It is a further objective of the present invention to provide an arrow vane which is economical to manufacture and durable in use.

SUMMARY OF THE INVENTION

The arrow vane of the present invention comprises an elongated base portion with an integrally formed solid fin extending outwardly therefrom. The fin is of a solid construction with corrugated ribs therein. The corrugations are set at a 45° angle with respect to the base portion. The vane is constructed of polyurathane material and there is at least one elongated opening formed through the fin.

DETAILED DESCRIPTION OF THE DRAWINGS

Figure 1:
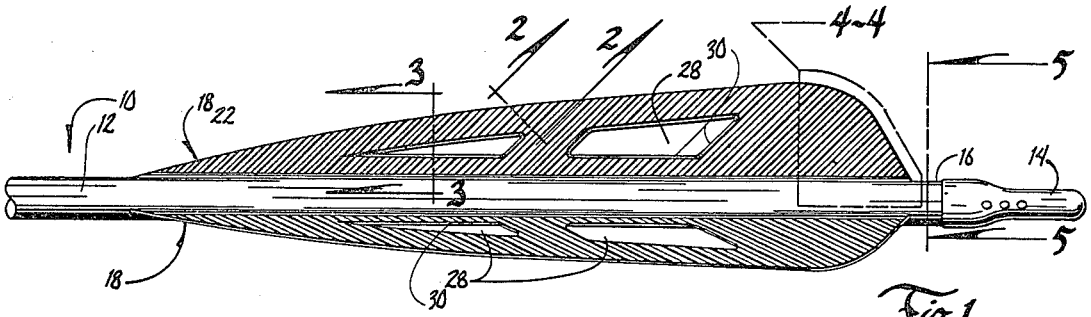
FIG. 1 is a perspective view of the rearward end of an arrow having the vanes of the present invention mounted thereon.
Figure 2:
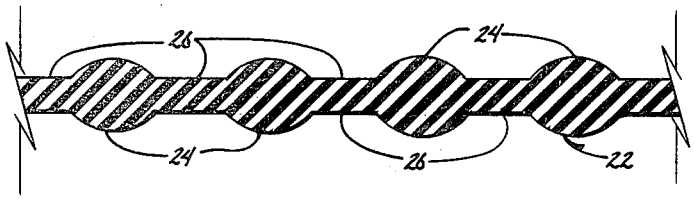
FIG. 2 is a view taken along lines 2—2 of FIG. 1 to show the cross-sectional shape of the fin of the vane.
Figure 3:
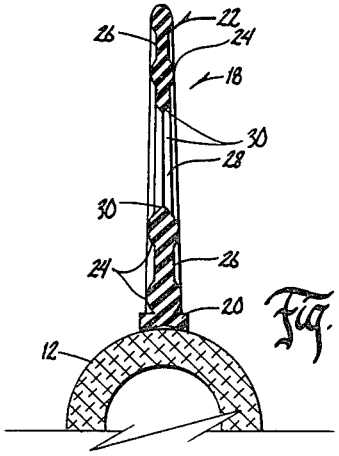
FIG. 3 is an end view taken along lines 3—3 of FIG. 1.
Figure 4:
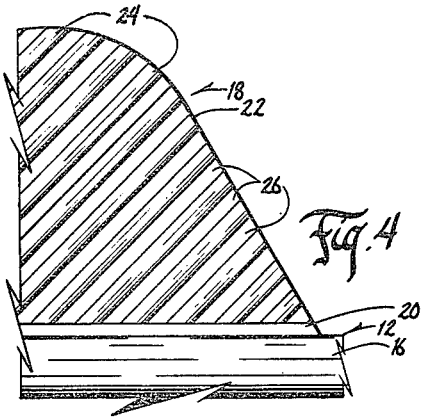
FIG. 4 is a side elevation view taken along lines 4—4 of FIG. 1.
Figure 5:
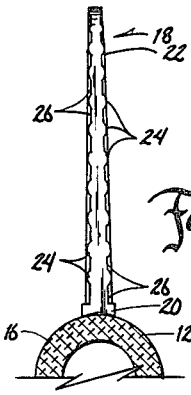
FIG. 5 is an end view taken along lines 5—5 of FIG. 1.

In FIG. 1 the numeral 10 generally designates the rearward end of an arrow having an elongated shaft 12 and a nock 14 connected to the rearward end 16 of shaft 12. Mounted near the rearward end 16 of shaft 12 is a plurality of vanes 18.

Vanes 18 have a base portion 20 and a fin 22 integrally formed with an extending outwardly from base portion 20. Fin 22 has a corrugated construction forming ribs 24 and interconnecting members 26. Ribs 24 and interconnecting members 26 are at a 45° angle with respect to the base portion 20.

The corrugated construction of vanes 18 breaks up the air flow and pushes the air away from the vanes when the arrow is in flight. This vane construction thus increases rotation and enhances speed, accuracy and distance of the arrow in flight.

Vane 18 also has openings 28 through fin 22 which also permit faster rotation of the arrow so as to increase the speed, accuracy and distance thereof. Openings 28 also eliminates any cross wind effect on the arrow. The edges 30 of openings 28 are V-shaped to reduce air resistance.

Vane 18 is constructed of polyurathane material using an injection molding process.

It can be seen that the arrow vane of the present invention accomplishes at least all of its stated objectives.

What is claimed is:

1. An arrow vane, comprising:

an elongated base portion, and an elongated solid fin integrally formed with and extending outwardly from said base portion, said fin having a corrugated construction and at least one elongated opening formed therethrough, said corrugated construction comprising a plurality of angularly disposed corrugations consisting of intermittent elongated parallel thick and narrow portions with at least the thick portion being arcuate in shape, said corrugations being at a fourth-five degree angle with respect to said base portion, said opening having V-shaped edges.

* * * * *